US011560744B2

(12) United States Patent
Pujol Oller et al.

(10) Patent No.: US 11,560,744 B2
(45) Date of Patent: Jan. 24, 2023

(54) HINGE DEVICE FOR OPENING AND CLOSING A VEHICLE DOOR

(71) Applicant: MASATS, S.A., Sant Salvador de Guardiola (ES)

(72) Inventors: Jordi Pujol Oller, Sant Salvador de Guardiola (ES); Josep Pons Comelles, Sant Salvador de Guardiola (ES); Jordi Freixa Ortiz, Sant Salvador De Guardiola (ES)

(73) Assignee: MASATS, S.A., Sant Salvador de Guardiola (ES)

( * ) Notice: Subject to any disclaimer, the term of this patent is extended or adjusted under 35 U.S.C. 154(b) by 606 days.

(21) Appl. No.: 16/500,978

(22) PCT Filed: Apr. 5, 2018

(86) PCT No.: PCT/ES2018/070300
§ 371 (c)(1),
(2) Date: Oct. 4, 2019

(87) PCT Pub. No.: WO2018/185358
PCT Pub. Date: Oct. 11, 2018

(65) Prior Publication Data

US 2020/0032568 A1 Jan. 30, 2020

(30) Foreign Application Priority Data

Apr. 6, 2017 (EP) ..... 17382189

(51) Int. Cl.
*E05D 1/00* (2006.01)
*E05D 15/34* (2006.01)
(Continued)

(52) U.S. Cl.
CPC ..... *E05D 15/34* (2013.01); *E05D 1/04* (2013.01); *E05D 13/00* (2013.01)

(58) Field of Classification Search
CPC ..... E05D 15/34; E05D 1/04; E05F 15/611; E05F 15/616; E05F 15/627; E05F 15/655; E05F 15/681; E05F 15/63
See application file for complete search history.

(56) References Cited

U.S. PATENT DOCUMENTS 5,289,615 A * 3/1994 Banks ..... B64C 1/143 244/905
8,365,359 B2 2/2013 Morishita et al.
2007/0084016 A1 4/2007 Bommelmann et al.

FOREIGN PATENT DOCUMENTS

DE 10 2004 008 069 A1 9/2005
EP 1 772 371 A2 4/2007
(Continued)

OTHER PUBLICATIONS

International Search Report of PCT/ES2018/070300 dated Sep. 27, 2018 [PCT/ISA/210].
European Search Report of EP 17 38 2189 dated Sep. 20, 2017.

*Primary Examiner* — Daniel J Troy
*Assistant Examiner* — Daniel Alvarez
(74) *Attorney, Agent, or Firm* — Sughrue Mion, PLLC

(57) ABSTRACT

The hinge device performs the opening and closing of a door of a vehicle without the door changing orientation. The device has an L-shaped arm provided with two ends attached in a pivotable way, around parallel rotation axes, to respective mounting bodies, one being fixable to the door and the other to the frame of the vehicle. Each body has a concentric pulley body with the respective rotation axis and fixed to a respective mounting body. The device further has a linking mechanism that extends along the arm and has a path formed by a first segment and a second segment that cross at least once.

13 Claims, 7 Drawing Sheets

(51) Int. Cl.
*E05D 1/04* (2006.01)
*E05D 13/00* (2006.01)

(56) References Cited

FOREIGN PATENT DOCUMENTS

| | | | | |
|---|---|---|---|---|
| EP | 2 333 216 | A1 | 6/2011 | |
| EP | 2363560 | A1 * | 9/2011 | ..... E05D 15/28 |
| ES | 2 296 135 | T3 | 4/2008 | |
| FR | 3029958 | A1 * | 6/2016 | ..... E05D 15/0634 |
| GB | 504 661 | A | 4/1939 | |
| JP | 2007-523278 | A | 8/2007 | |

* cited by examiner

Fig. 3
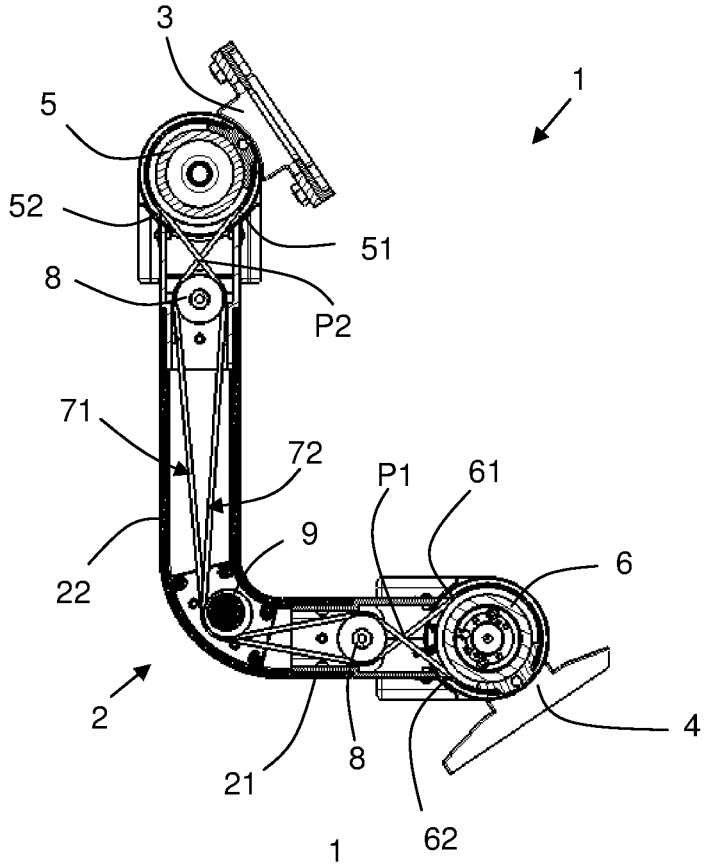
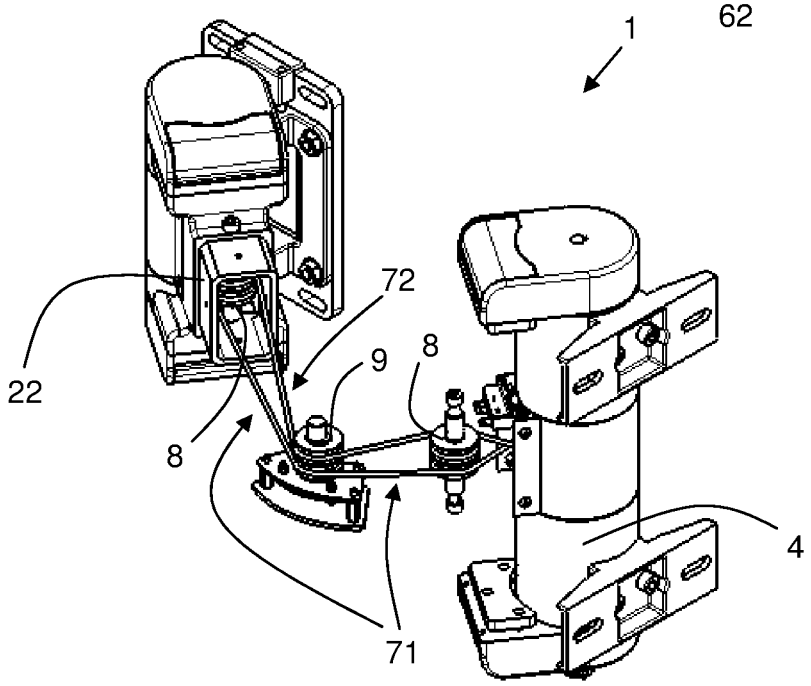
Fig. 4

HINGE DEVICE FOR OPENING AND CLOSING A VEHICLE DOOR

CROSS REFERENCE TO RELATED APPLICATIONS

This application is a National Stage of International Application No. PCT/ES2018/070300, filed Apr. 5, 2018, claiming priority to European Patent Application No. 17382189.3, filed Apr. 6, 2017.

APPLICATION FIELD OF THE INVENTION

The present invention relates to a hinge device for opening and closing a door of a vehicle such as a bus, configured so that the door remains parallel to the side of the vehicle that it is attached to at all times.

BACKGROUND OF THE INVENTION

In public transportation vehicles, such as buses, it is increasingly common for doors to be mounted on the frame or body of the vehicle by means of hinges designed to open and close the door, such that said door does not change orientation and remains parallel to the frame.

The publication of European patent application EP2333216-A1, in its section on the description of the state of the art, refers to the FIGS. 15 and 16 thereof, which pertain to a hinge for buses that opens and closes the door, keeping the door parallel at all times.

As explained in this section, the link of said FIG. 15 is connected to a vehicle body of a bus and its door. The end of the link is connected to an axis part of the vehicle body rotatably and the other end of the link is connected to an axis part of the door rotatably. Besides, a first pulley is connected integrally with the axis part of the vehicle body and a second pulley is connected integrally with the axis part of the door. Between the first pulley and the second pulley, a timing belt is placed thereover. In the explanation of the operation of the hinge device during opening and closing, it is indicated that the attitude of the door relative to the vehicle body is defined by combination of the rotation angle of the link relative to the axis part of the vehicle body and the rotation angle of the second pulley relative to the link. As the rotation angle of the link and the rotation angle of the second pulley relative to the link cancel out each other, when opening or closing the door, the attitude of the door is maintained fixed and the door is pivoted around the axis part of the vehicle body while it keeps parallel with the back-and-forth direction of the vehicle body.

It also indicates that the axis part of the vehicle is fixed to the inner surface of the vehicle body and the axis part of the door is fixed to the back surface of the door. Therefore, if the open angle of the door is to be increased, the link interferes with the inner surface of the vehicle body and the open angle of the door cannot be increased. In order to increase the open angle of the door, as illustrated in FIG. 16, the link and the timing belt are bent into an L shape at their midpoint so as to prevent interference of the link and the timing belt with the inner surface of the vehicle body.

In EP2333216-A1, the Japanese patent application JP2007-523278 is cited as a reference, the patent family of which belongs to patent ES2296135-T3. The patent ES2296135-T3 aims to create a hinge device for connecting a moving part to a stationary part in which, between the two mutually staggered yet parallel oriented positions, to move from one position to the other, the stationary part at least runs through a pivoted position relative to these parallel positions. They pursue this objective to prevent problems of a temporary buildup of excess pressure and the catching difficulty of the door locking mechanism. Thus, in this intermediate step, parallel orientation is not maintained as shown when comparing FIGS. 1 and 2 of this patent, wherein FIG. 1 does not belong to the invention claimed in ES2296135-T3.

The difference between the hinge devices of FIGS. 1 and 2 of ES2296135-T3 lies in the fact that for FIG. 1, the two pulleys are circular and have the same diameter, such that, upon movement from a closed position between the posts to an open position, the door always maintains the same orientation. On the other hand, in the device of FIG. 2, according to the invention claimed in said document, at least one of the pulleys is not circular. Other embodiments are also described in which the arms have an angled shape, such as in FIGS. 4 and 5. The timing belt on the inside of the arm is guided by two rollers at an angle of 90°. The two pulleys around which the timing belt loops are elliptical.

The invention object of the document EP2333216-A1 and of the patent U.S. Pat. No. 8,365,359 consists of a hinge device for opening and closing a second member (such as a door) relative to a first member (such as the frame of a vehicle). The device comprises a first mounting element mounted on the first member and having an axis part; a second mounting element mounted on the second member and having an axis part; a first pulley fixed to the axis part of the first mounting element; a second pulley fixed to the axis part of the second mounting element; a looping member that runs between the first pulley and the second pulley; a connecting member that is connected to the part of the first mounting element to be rotatable with respect to the first mounting element and connected to the axis part of the second mounting element to be rotatable with respect to the second mounting element; and an abutting part that abuts to the outside of the looping member in such a manner that a width between one side of the looping element and the opposite side thereof becomes smaller than the diameter of at least one of the pulleys.

The figures of EP2333216-A1 and U.S. Pat. No. 8,365,359 show that the connecting member is a straight, not angled, element, and the looping member is a closed belt with ends that loop around the two pulleys. The abutting part has several elements that make the belt narrower at the outlet of each of the two pulleys.

Another document is the United States patent application US2007084016-A1, which refers to a hinge device comprising a lever that is provided with two end parts, which are used for assembling the lever to a door or hood or a frame and are pivotable about pins located at the ends of the lever, respectively. The invention particularly relates to a hinge device for a rotatable and pivotable door that can pivot open in a parallel fashion, as a pantograph-type door. Its FIGS. 3 and 4 show a special embodiment of the device in which the lever has an angled shape with its articulated ends. Along the inside of the angled lever is a toothed belt (see traction ropes) arranged wrapped around disks and the shape thereof is maintained by the arrangement of deflection rollers.

One of the disadvantages of the types of hinges like those described is that the belts tend to loosen over time and the entire device must be dismounted to reach the right tension for opening and closing the door, which takes time and labor. It is also desirable for the door to remain parallel to the frame of the vehicle at all times during opening and closing operations, without any of its edges protruding at an incline to avoid accidents. Furthermore, it is also preferable that the hinge device is formed by components that are accessible and available on the market, without having to use non-conventional pulleys, which occupies the least amount of space possible and with components that interfere as little as possible with the surroundings, in other words, that they are not an obstacle to the entry and exit of passengers.

DESCRIPTION OF THE INVENTION

For the purpose of providing an alternative solution, a hinge device for operating the opening and closing of a door fastened to the frame of a vehicle, configured so that the door does not change orientation during said operation, is made known. The hinge device comprises an arm provided with two ends attached in a pivotable way, around parallel rotation axes, to respective mounting bodies, one being fixable to the door and the other to the frame of the vehicle. Each mounting body comprises, coinciding with each associated end of the arm, a concentric pulley body with a respective rotation axis and fixed to a respective mounting body. The hinge device further comprises linking means that extend along the arm and rest on the pulley grooves, being partially rolled up, and two end contact points being determined on the linking means for each of the pulley grooves.

Essentially, the hinge device of the invention is characterized in that the arm has an angled shape, having two angled sections configured in a general L shape, in that the path of the linking means comprises a first segment and a second segment, the first segment being the one that extends between the first end contact points of the pulley grooves and the second segment being the one that extends between the second end contact points of the pulley grooves, and in that the path of the linking means comprises at least one crossing of segments, wherein the first segment crosses the second segment.

According to another characteristic of the invention, the arm comprises at least one diverting element arranged on one of its angled sections, between the bend of the arm and one of the pulley bodies, the contour surface of which is convex-curved, having a diameter smaller than the diameter of any of the pulley bodies, and where one of its sides is in contact with the first segment and another one of its sides is in contact with the second segment of the path of the linking means, the arm at least one diverting element being arranged such that the crossing of segments is located between the diverting element and the pulley body located on the same section of the arm upon which the diverting element is arranged.

According to another characteristic of the invention, the arm comprises, in addition to the at least one diverting element, a central diverting element arranged on the bend of the arm, the contour surface of which is convex-curved, having a diameter smaller than the diameter of any of the pulley bodies, and where one of its sides is in contact with both the first segment and the second segment of the path of the linking means.

According to another characteristic of the invention, the arm comprises at least two diverting elements, each one arranged on one of its angled sections, between the bend of the arm and one of the pulley bodies, the contour surface of which is convex-curved and having a diameter smaller than the diameter of any of the pulley bodies. Each one of the two diverting elements is in contact on one of its sides with the first segment and another one of its sides is in contact with the second segment of the path of the linking means, each diverting element being arranged such that there is a crossing of segments located between each diverting element and the corresponding pulley body located on the same angled section of the arm upon which the diverting element is arranged.

According to another characteristic of the invention, the first segment and the second segment of the path of the linking means run at different heights at least between a diverting element and the central diverting element, such that the contact section of the part of the linking means that follow the first segment with the convex-curved contour surface of the central diverting element is located vertically above or below the contact section of the part of the linking means that follow the second segment with the convex-curved contour surface of the central diverting element, the vertical direction being a direction parallel to that of the rotation axes with respect to which the ends of the arm pivot.

According to another characteristic of the invention, at least one crossing between the first segment and the second segment of the path of the linking means occurs at a different height, one segment being located at a height that is different than that of the other, and being considered a height measured according to a direction parallel to that of the rotation axes with respect to which the ends of the arm pivot.

According to another characteristic of the invention, the convex-curved contour surfaces of the central diverting element and of the diverting element or elements are provided with perimeter slots for guiding the contact of the linking means with said surfaces.

According to another characteristic of the invention, the arm comprises, in addition to the at least one diverting element, a central diverting element arranged on the bend of the arm, the contour surface of which is convex-curved, having a diameter smaller than the diameter of any of the pulley bodies, and where one of its sides is in contact with both the first segment and the second segment of the path of the linking means.

According to a preferred embodiment of the invention, the arm comprises at least two diverting elements, each one arranged on one of its angled sections, between the bend and one of the pulley bodies, the contour surface of which is convex-curved and has a diameter smaller than the diameter of any of the pulley bodies, each one of the two diverting elements being in contact on one of its sides with the first segment and another one of its sides being in contact with the second segment of the path of the linking means and each diverting element being arranged such that there is a crossing of segments located between each diverting element and the corresponding pulley body located on the same angled section of the arm upon which the diverting element is arranged.

According to another characteristic of the invention, the first segment and the second segment of the path of the linking means run at different heights at least between a diverting element and the central diverting element, such that the contact section of the part of the linking means that follow the first segment with the convex-curved contour surface of the central diverting element is vertically located above or below the contact section of the part of the linking means that follow the second segment with the convex-curved contour surface of the central diverting element, the vertical direction being a direction parallel to that of the rotation axes with respect to which the ends of the arm pivot.

According to another characteristic of the invention, the at least one crossing between the first segment and the second segment of the path of the linking means occurs at a different height, one segment being located at a height that is different than that of the other, and being considered a height measured according to a direction parallel to that of the rotation axes with respect to which the ends of the arm pivot.

Preferably, the convex-curved contour surfaces of the central diverting element and of the diverting element or elements are provided with perimeter slots for guiding the contact of the linking means with said surfaces.

Also preferably, the pulley grooves comprise two perimeter portions located at different heights around the respective pulley body, or they are configured according to a helical path around the respective pulley body for guiding the contact of the linking means with the pulley grooves.

According to another characteristic of the invention, the central diverting element is formed by a prismatic body with an elliptical base, with the ability to rotate around an axis parallel to the rotation axes with respect to which the ends of the arm pivot, said axis of the central diverting element being firmly attached to the arm, and being locked in a specific rotation position wherein the linking means adopt a state of tension upon contact with the central diverting element.

The linking means can be formed by at least a belt, a cable, a filiform element or a chain. According to a preferred embodiment of the invention, the linking means comprise at least a flat belt made up of a sheath that contains a plurality of cords arranged in parallel and formed by filiform elements, preferably intertwined. The filiform elements can be made from steel or aramid. The sheath is a polymeric material, preferably of polyurethane.

According to the preferred embodiment, the linking means in particular comprise two flat belts as described previously, wherein one belt follows the path of the first segment and the other belt follows the path of the second segment.

According to another characteristic of this preferred embodiment, the first ends and the second ends of each belt are fixed in a removable way and respectively to the pulley grooves of the first pulley and the second pulley.

Advantageously, according to another characteristic of this preferred embodiment, the two belts of the linking means have the same length, which greatly facilitates mounting of the hinge device.

According to another characteristic of the invention, the mounting body that may be fixed to the door houses in its interior a motor with a rotation axis that causes the arm to rotate.

BRIEF DESCRIPTION OF THE DRAWINGS

The accompanying drawings illustrate by way of non-limiting example, a preferred embodiment of the hinge device object of the invention. In said drawings:

FIG. 3 is a plan view of the inside of the hinge device of FIG. 2;

FIG. 4 is a perspective view of the hinge device of FIG. 2, however some outer parts of the arm are not shown in order to show the arrangement of the central diverting element and the diverting element that comes in contact with the first segment of the path of the linking means;

DETAILED DESCRIPTION OF THE DRAWINGS

Figure 1:
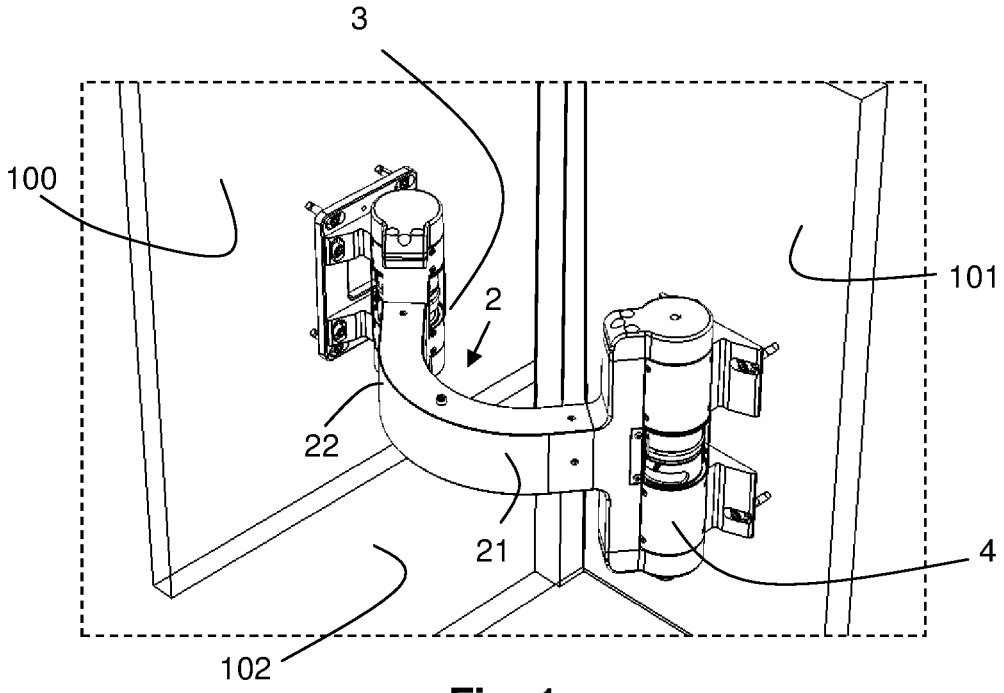
FIG. 1 is a perspective view of the hinge device object of the invention, fastened to a frame of a vehicle and to a door thereof, in an intermediate position between a closed door and an open door.
Figure 2:
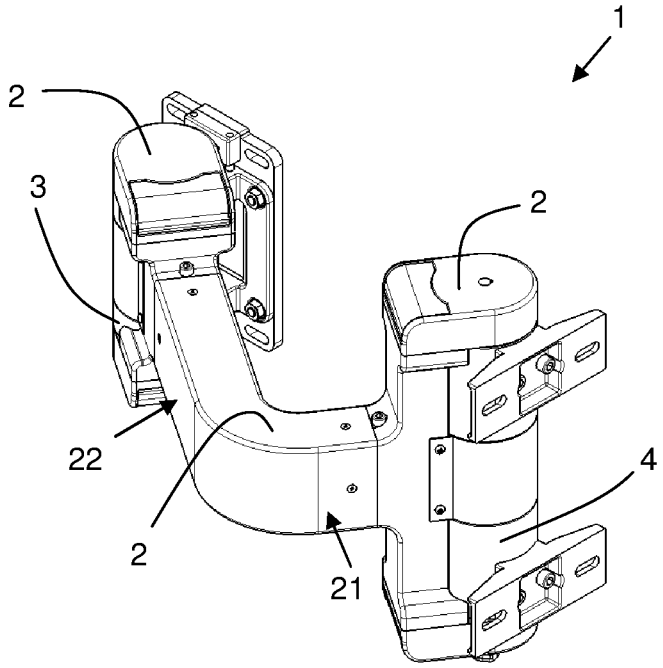
FIG. 2 is a perspective view of the hinge device object of the invention, in a closed door position.
Figure 5A:
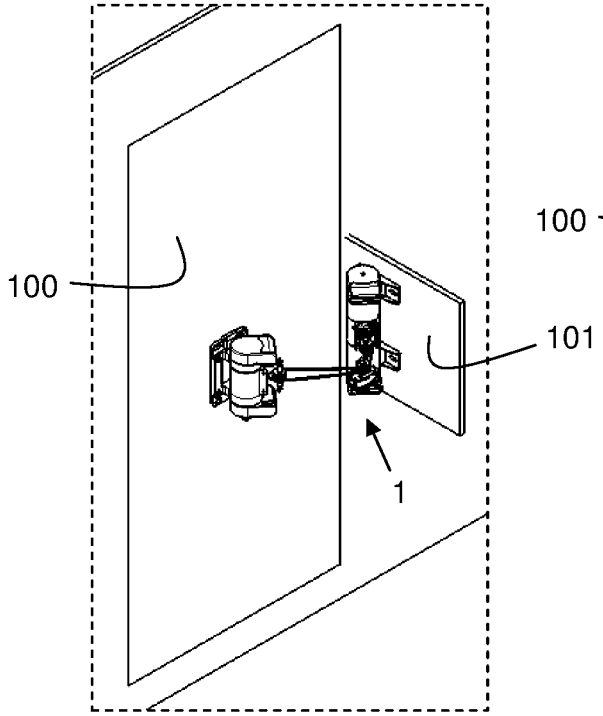
FIGS. 5*a*, 5*b*, 5*c* and 5*d* are perspective views of the hinge device object of the invention fastened to the frame of a vehicle and the door thereof at different positions that range from a closed door position to an open door position, respectively, wherein the device is shown without the outer part of the arm in order to show the elements arranged therein.
Figure 5B:
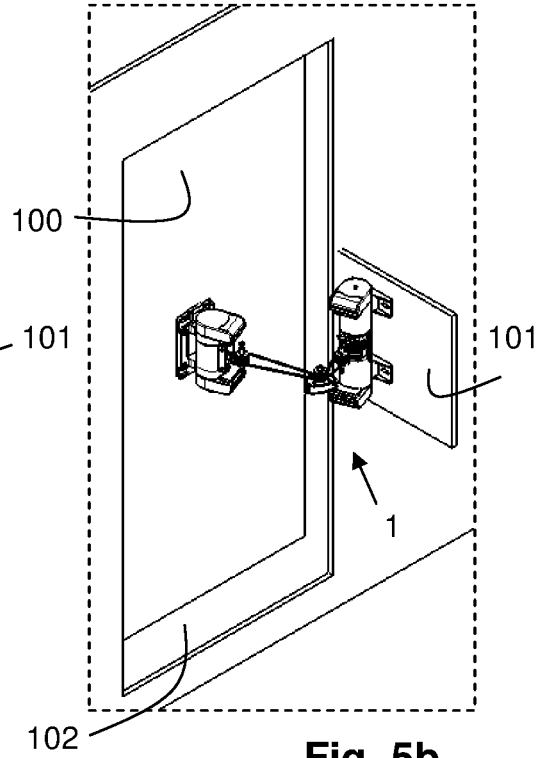
Figure 5C:
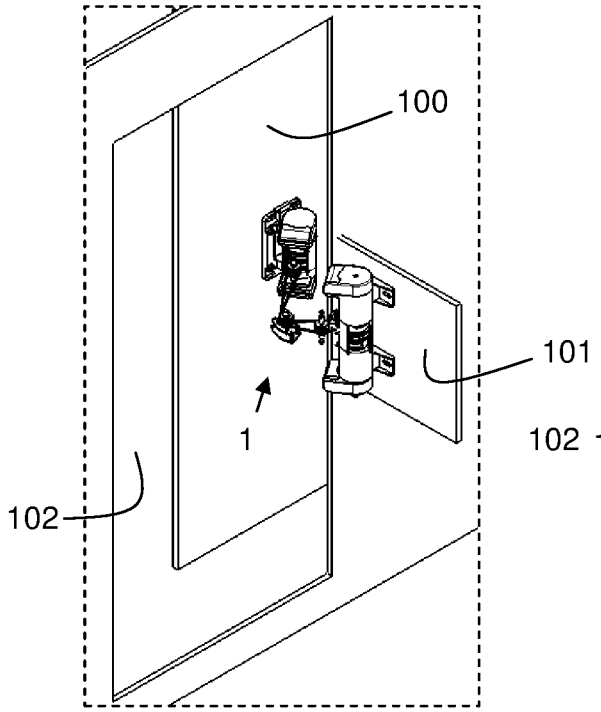
Figure 5D:
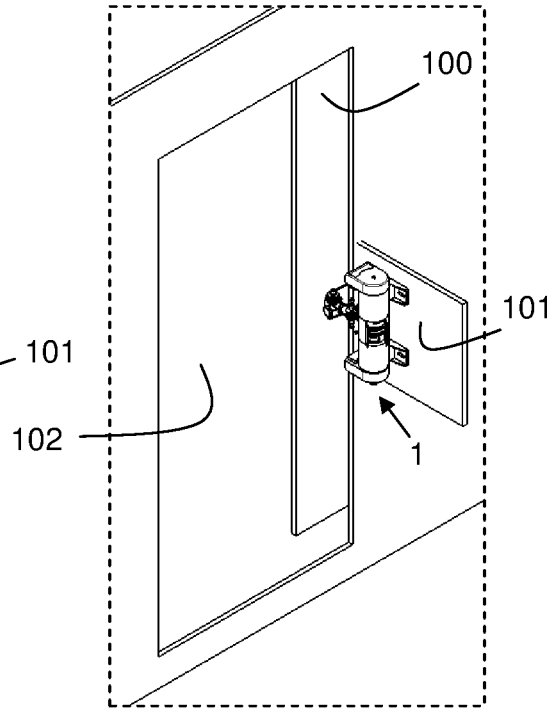
Figure 6A:
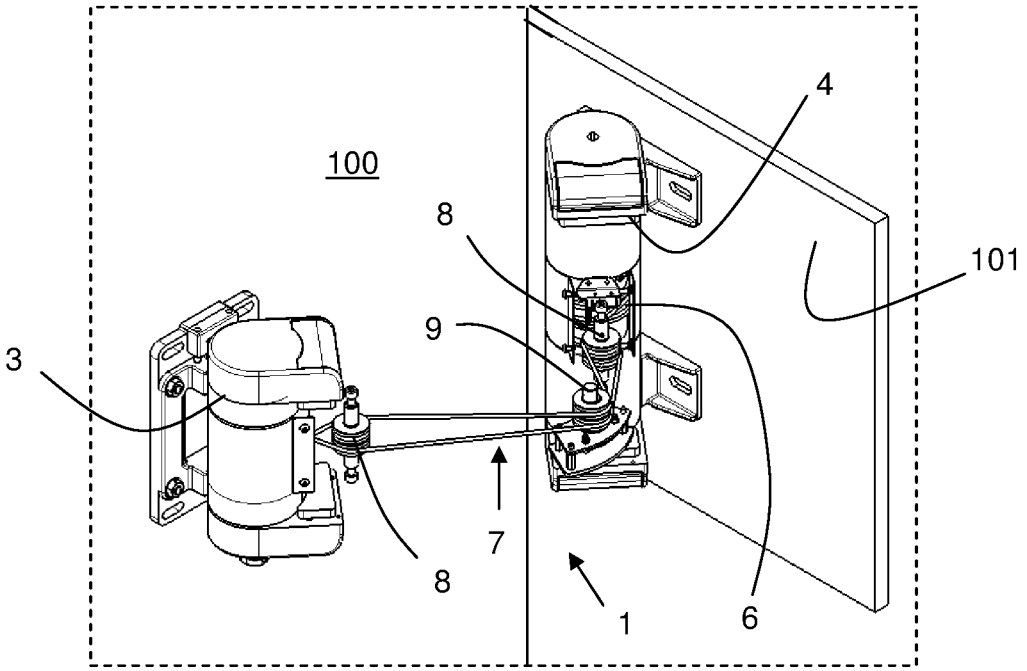
FIGS. 6*a*, 6*b*, 6*c* and 6*d* are enlarged views of the hinge device shown in FIGS. 5*a*, 5*b*, 5*c* and 5*d*, respectively.
Figure 6B:
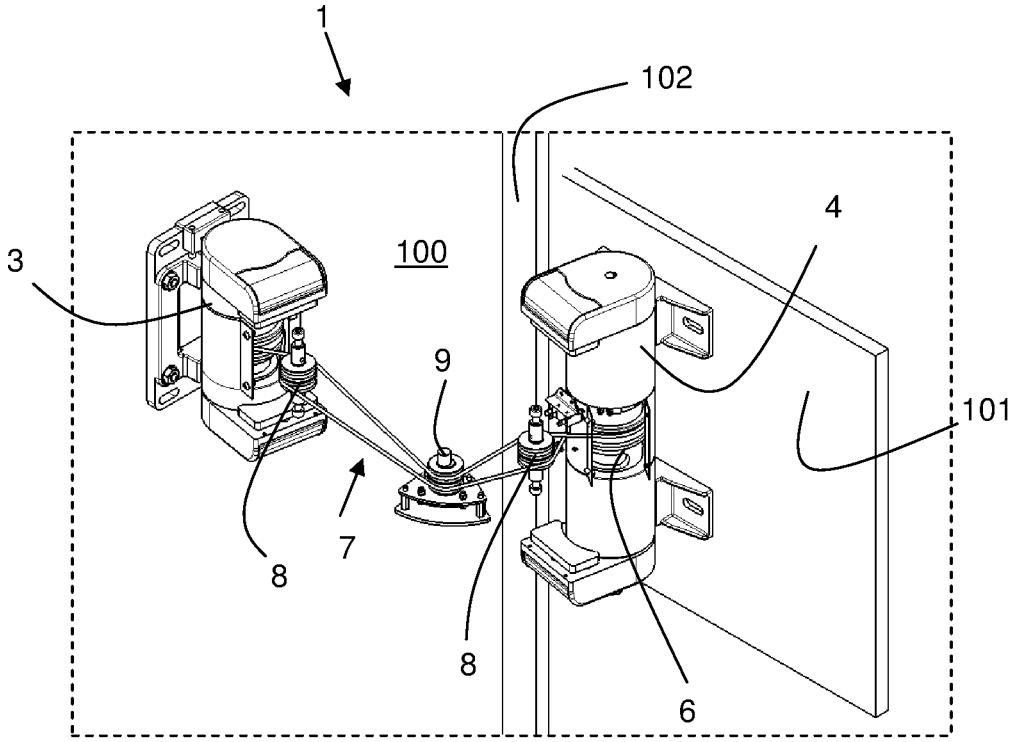
Figure 6C:
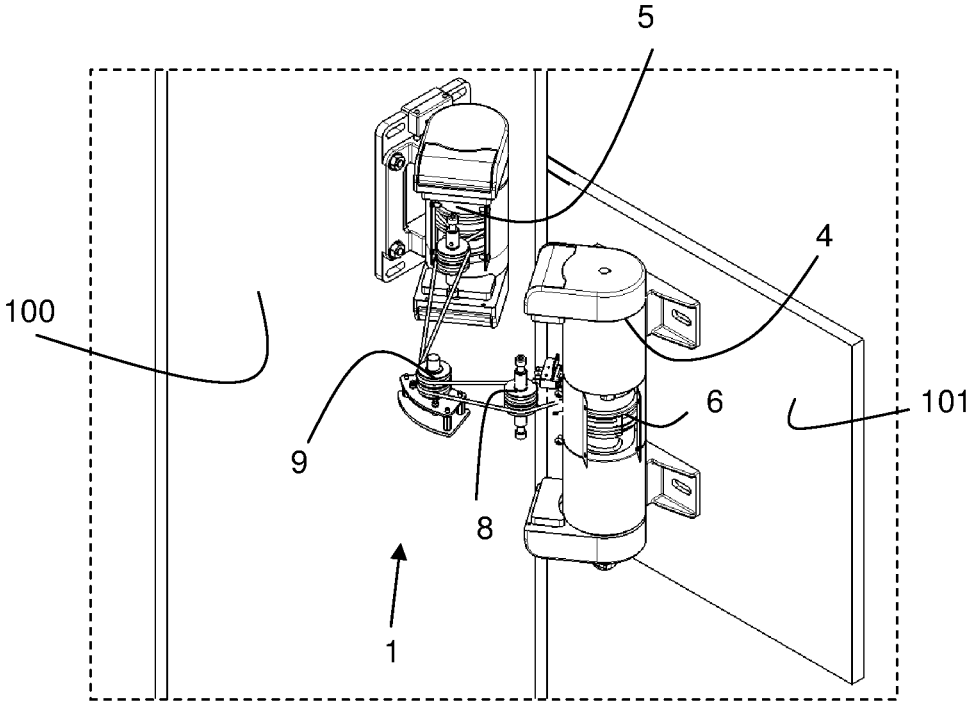
Figure 6D:
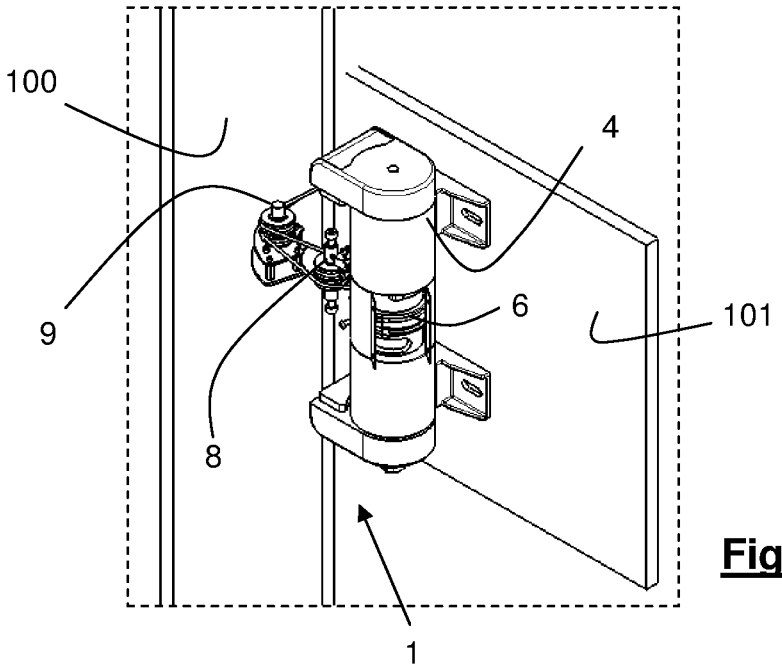

FIG. 1 shows the hinge device 1 object of the invention, fastened to a frame 101 of a vehicle and a door 100 thereof, in an intermediate position between a closed door and an open door 100. FIG. 2 shows the same hinge device 1 but isolated and in a closed door 100 position (FIG. 2). The hinge device 1 for performing the opening and closing of the door 100 fastened to the frame 101 is configured so that the door 100 does not change orientation during said operation, as observed in FIGS. 5*a* to 5*d*, which sequentially show the positions of the components of the hinge device 1 from the closed door 100 position to the open door 100 position.

FIGS. 1 and 2 show that the hinge device 1 comprises an arm 2 provided with two ends attached in a pivotable way, around parallel rotation axes, to respective mounting bodies 3 and 4. The first mounting body 3 can be fixed to the door 100 by a bolt joint plate or by any other form of conventional fastening (see FIG. 8), while the second mounting body 4 can be fixed in a similar way to the frame 101 of the vehicle, at a short distance from the opening 102 of the frame 101 where the door 100 fits, as shown in FIG. 1. The mounting body 3 that may be fixed to the door 100 houses in its interior a motor with a rotation axis that causes the arm 2 to rotate to open and close the door 100 (see FIGS. 5*a* to 5*d*).

Each mounting body 3, 4 comprises, coinciding with each associated end of the arm 2, a concentric pulley body 5, 6 with the respective rotation axis and fixed to a respective mounting body 3, 4. This can be seen in FIG. 3, wherein the pulley body 5 forms part of the first mounting body 3 and the pulley body 6 forms part of the second mounting body 4.

FIG. 3 also shows that the hinge body 1 further comprises linking means 7 that extend along the arm 2 and rest on the pulley grooves 5, 6. The linking means 7 are partially rolled up in the pulley grooves 5, 6, the linking means 7 on the grooves determining two end contact points 51 and 52 on the first pulley 5 and 61 and 62 on the second pulley 6.

On the hinge device 1, it is worth noting that the arm 2 has an angled shape, such that two angled sections 21 and 22 are clearly distinguished, configuring a general L shape. In the drawings, only FIGS. 1 to 3 show the angled shape of the arm 2, since the other figures do not show part of the arm 2 in order to show the linking means 7 that run along its interior and other components that will be explained further on.

In FIGS. 1-4 and 6*a*-6*d* it is easy to see that the path of the linking means 7 comprises a first segment 71 and a second segment 72. The first segment 71 extends between the first end contact points 51 and 61 of the pulley grooves 5 and 6, while the second segment 72 extends between the second end contact points 52 and 62 of the pulley grooves 5 and 6. It is very important to note that the path of the linking means 7 comprises at least one crossing of segments wherein the first segment 71 crosses the second segment 72. In fact, in the hinge device 1 shown in the drawings, the path comprises two crossings P1 and P2, as shown in FIG. 3.

Furthermore, FIG. 3 shows that the arm 2 comprises two diverting elements 8, each one arranged on one of its angled sections 21, 22 between the bend of the arm 2 and a corresponding pulley body 5, 6. The contour surface of each diverting element is convex-curved and has a diameter smaller than the diameter of any of the pulley bodies 5 and 6. Each one of the two diverting elements 8 is in contact on one of its sides with the first segment 71 and another one of its sides is in contact with the second segment 72 of the path of the linking means 7. Each diverting element 8 is arranged such that there is a crossing P1, P2 of segments located between each diverting element 8 and the corresponding pulley body 5, 6 located on the same angled section 21, 22 of the arm 2 upon which the diverting element 8 is arranged.

The arm 2 comprises, in addition to the two diverting elements 8, a central diverting element 9 arranged on the bend of the arm 2, the contour surface of which is convex-curved, having a diameter smaller than the diameter of any of the pulley bodies 5 and 6. FIG. 4 clearly shows that one side of the contour surface of the central diverting element 9 is in contact with both the first segment 71 and the second segment 72 of the path of the linking means. In other words, a crossing of segments as such does not occur on the central diverting element 9.

In fact, the first segment 71 and the second segment 72 of the path of the linking means 7 run at different heights at least between a diverting element 8 and the central diverting element 9, such that the contact section of the part of the linking means 7 that follow the first segment 71 with the convex-curved contour surface of the central diverting element 9 is located vertically above or below the contact section of the part of the linking means 7 that follow the second segment 71 with the convex-curved contour surface of the central diverting element 9. In light of the above, it is considered that the vertical direction is a direction parallel to that of the rotation axes with respect to which the ends of the arm 2 pivot. This vertical arrangement of the segments 71 and 72 can be seen in FIGS. 4 and 6*a*-6*d*.

Furthermore, the crossings P1 and P2 between the first segment 71 and the second segment 72 occur at different heights, one segment being located at a height that is different from that of the other, and being considered a height measured according to a direction parallel to that of the rotation axes with respect to which the ends of the arm 2 pivot.

Figure 8:
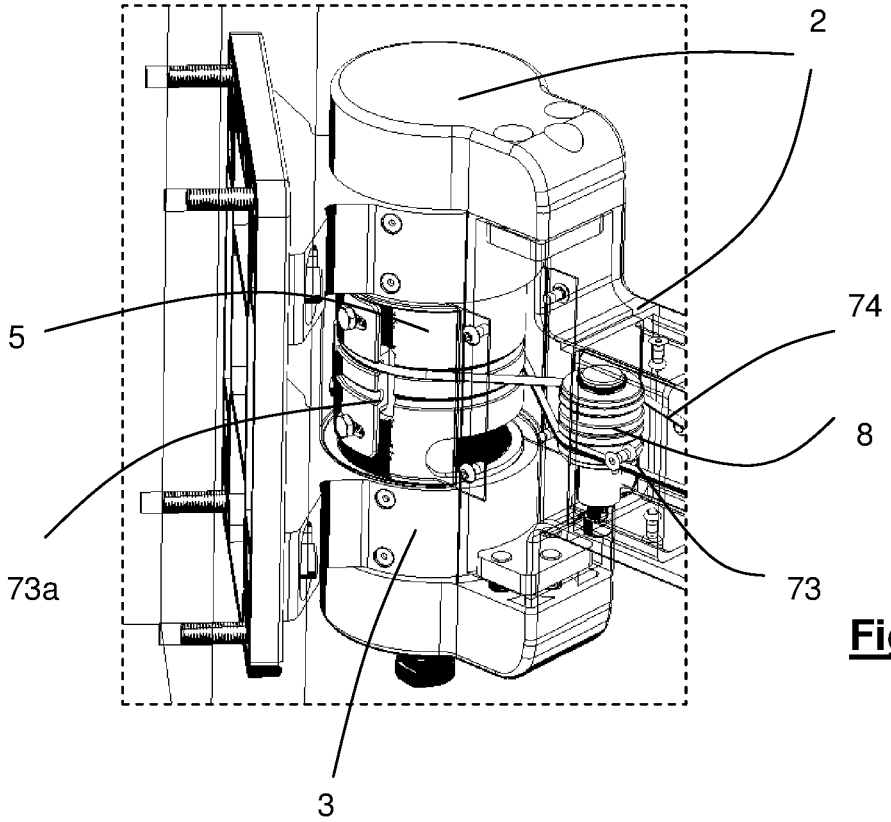
FIG. 8 shows another detailed view of the arm attached to the mounting body fixed to the door, partially uncovered to show grooves of the first pulley and the perimeter slots of the closest diverting body.

To favor the vertical arrangement of the first segment 71 with respect to the second segment 72, the convex-curved contour surface of the central diverting element 9 and of the diverting elements 8 are provided with perimeter slots for guiding the contact of the linking means 7 with said surfaces (see FIG. 8).

Figure 7:
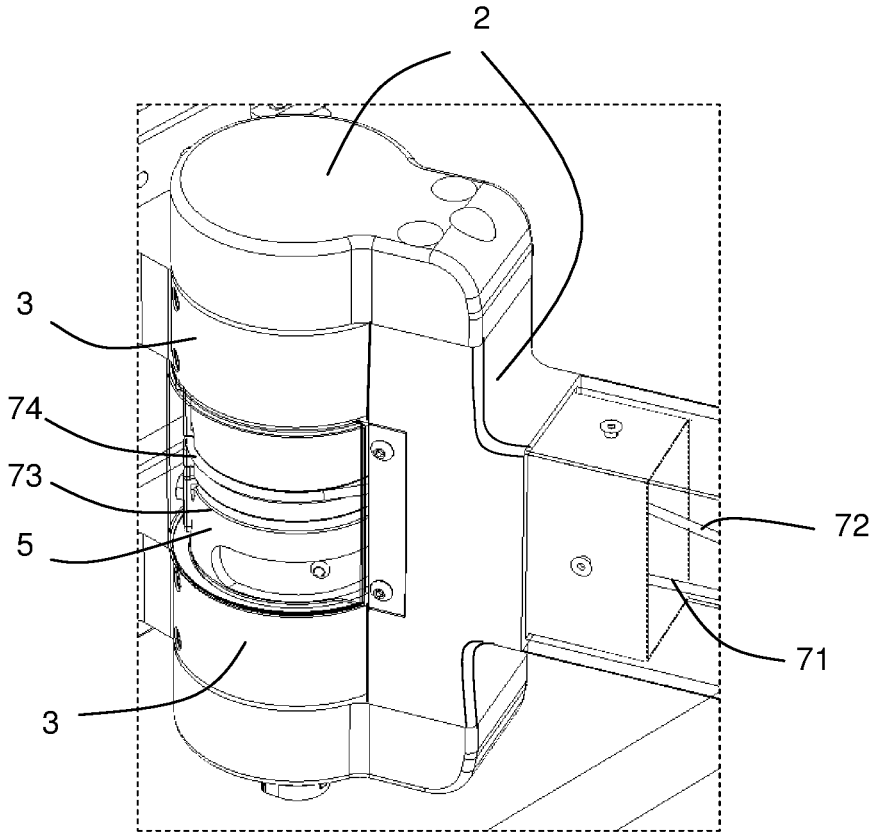
FIG. 7 is a detailed view of the end of the arm attached to the mounting body fixed to the door, partially uncovered to show the first pulley grooves.

For the same purpose, the pulley grooves 5 and 6 comprise two perimeter portions located at different heights around the respective pulley body 5, 6, or they are configured according to a helical path around the respective pulley body 5, 6 for guiding the contact of the linking means 7 with the pulley grooves 5 and 6. This configuration can be seen in FIGS. 6*d*, 7 and 8.

The central diverting element 9 is formed by a prismatic body with an elliptical base, with the ability to rotate around an axis parallel to the rotation axes with respect to which the ends of the arm 2 pivot. The axis of the central diverting element 9 is firmly attached to the arm 2. Advantageously, the central diverting element 9 is able to be locked in a specific rotation position wherein the linking means 7 adopt a state of tension upon contact with the central diverting element 9. Thus, thanks to the configuration of its elliptical base, when it rotates vertically, the distance from its rotation center to its contact surface with the segments 71 and 72 varies, meaning that the linking means are tensed when the distance increases, and loosening occurs when it rotates to decrease tension, if considered excessive or to facilitate disassembling tasks.

Although the linking means can be formed by a single element, preferably a flat belt that follows the path indicated, with variations in height depending on the segment, the linking means 7 preferably comprise two elements in the form of flat straps or belts 73 and 74 (see FIG. 7), wherein a belt 73 follows the path of the first segment 71 and the other belt 74 follows the path of the second segment 72. The two flat belts 73 and 74 of the linking means 7 have the same length, which greatly facilitates the mounting of the hinge device 1, since it is not necessary to distinguish one from the other.

Figure 9:
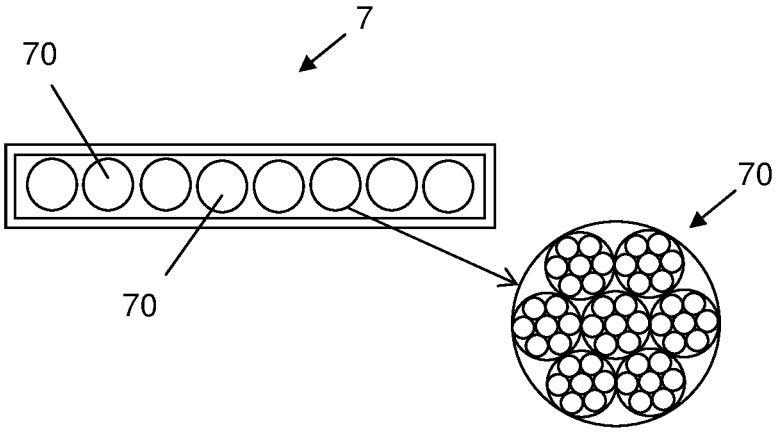
FIG. 9 is a detailed view of the transverse cross section of one of the two flat belts that make up the linking means according to the preferred embodiment of the invention.

Preferably, as shown in FIG. 9, corresponding to the section according to a transverse cross section of one of the flat belts 73 or 74, each belt is made up of a casing or sheath 75 that contains a plurality of cords 70 arranged in parallel and formed by filiform elements, preferably intertwined. The filiform elements are preferably made from steel or aramid. The sheath 75 is a polymeric material, preferably of polyurethane.

Each filiform element 73 and 74 has a first end and a second end that are fixed in a removable way and respectively to the pulley grooves of the first pulley 5 and the second pulley 6. The first end 73*a* of the filiform element 73 is shown in FIG. 8. In order to fix the first end 73*a*, the groove of the first pulley 5 is arranged on a plate or sheet configured to clip and keep said end retained.

The invention claimed is:

1. A hinge device for operating the opening and closing of a door fastened to a frame of a vehicle, configured so that the door does not change orientation during said operation, wherein the hinge device comprises an arm provided with two ends attached in a pivotable way, around parallel rotation axes, to respective mounting bodies, one being fixable to the door and the other to the frame of the vehicle, wherein each mounting body comprises, coinciding with each associated end of the arm, a concentric pulley body with a respective rotation axis and fixed to a respective mounting body, and the hinge device further comprising linking means that extend along the arm and rest on the pulley grooves, being partially rolled up determining two end contact points on the linking means with each of the pulley grooves, wherein the arm has an angled shape, having two angled sections configured in a general L shape, the path of the linking means comprises a first segment and a second segment, the first segment being the one that extends between the first end contact points of the pulley grooves and the second segment being the one that extends between the second end contact points of the pulley grooves, and the path of the linking means comprises at least one crossing of segments, wherein the first segment crosses the second segment;

wherein the arm comprises at least one diverting element arranged on one of the angled sections of the arm, between the bend of the arm and one of the pulley bodies, the contour surface of which is convex-curved, having a diameter smaller than the diameter of any of the pulley bodies, and where one side of the diverting element is in contact with the first segment and another side of the diverting element is in contact with the second segment of the path of the linking means, the at least one diverting element being arranged such that the crossing (P1, P2) of segments is located between the diverting element and the pulley body located on the same section of the arm upon which the diverting element is arranged; and wherein the arm further comprises, a central diverting element arranged on the bend of the arm, the contour surface of which is convex-curved, having a diameter smaller than the diameter of any of the pulley bodies, and where one side of the central diverting element is in contact with both the first segment and the second segment of the path of the linking means.

2. The hinge device according to claim 1, wherein the arm comprises at least two diverting elements, each one arranged on one of its angled sections, between the bend of the arm and one of the pulley bodies, the contour surface of which is convex-curved and has a diameter smaller than the diameter of any of the pulley bodies, each one of the two diverting elements being in contact on one of its sides with the first segment and another one of its sides being in contact with the second segment of the path of the linking means, and each diverting element is arranged such that there is a crossing (P1, P2) of segments located between each diverting element and the corresponding pulley body located on the same angled section of the arm upon which the diverting element is arranged.

3. The hinge device according to claim 1, wherein the first segment and the second segment of the path of the linking means run at different heights at least between a diverting element and the central diverting element, such that the contact section of the part of the linking means that follow the first segment with the convex-curved contour surface of the central diverting element is located vertically above or below the contact section of the part of the linking means that follow the second segment with the convex-curved contour surface of the central diverting element, the vertical direction being a direction parallel to that of the rotation axes with respect to which the ends of the arm pivot.

4. The hinge device according to claim 1, wherein the at least one crossing (P1, P2) between the first segment and the second segment of the path of the linking means occurs at a different height, one segment being located at a height that is different than that of the other, being considered a height measured according to a direction parallel to that of the rotation axes with respect to which the ends of the arm pivot.

5. The hinge device according to claim 3, wherein the convex-curved contour surfaces of the central diverting element and of the diverting element or elements are provided with perimeter slots for guiding the contact of the linking means with said surfaces.

6. The hinge device according to claim 5, wherein the pulley grooves comprise two perimeter portions located at different heights around the respective pulley body, or they are configured according to a helical path around the respective pulley body for guiding the contact of the linking means with the pulley grooves.

7. The hinge device according to claim 1, wherein the central diverting element is formed by a prismatic body with an elliptical base, with the ability to rotate around an axis parallel to the rotation axes with respect to which the ends of the arm pivot, said axis of the central diverting element being firmly attached to the arm, and being locked in a specific rotation position wherein the linking means adopt a state of tension upon contact with the central diverting element.

8. The hinge device according to claim 1, wherein the linking means comprise at least one belt or at least one filiform element.

9. The hinge device according to claim 8, wherein the linking means comprise two belts and wherein one belt follows the path of the first segment and the other belt follows the path of the second segment.

10. The hinge device according to claim 9, wherein the first ends and the second ends of each belt are secured in a removable way to the pulley grooves of the first pulley and the second pulley, respectively.

11. The hinge device according to claim 10, wherein the two belts of the linking means have the same length.

12. The hinge device according to claim 8, wherein each belt of the linking means is flat and is made up of a sheath that contains a plurality of cords arranged in parallel and formed by intertwined filiform elements.

13. The hinge device according to claim 1, wherein the mounting body that may be fixed to the door houses a motor with a rotation axis that causes the arm to rotate.

* * * * *